United States Patent [19]

Riedel

[11] Patent Number: 4,756,036

[45] Date of Patent: Jul. 12, 1988

[54] CONTINUOUS TREATMENT OF STRIP TEXTILE FABRICS

[75] Inventor: Dieter Riedel, Porta Westfalica, Fed. Rep. of Germany

[73] Assignee: Johannes Menschner Maschinenfabrick, Kampweg, Fed. Rep. of Germany

[21] Appl. No.: 45,237

[22] Filed: May 1, 1987

Related U.S. Application Data

[63] Continuation of Ser. No. 720,741, Apr. 8, 1985, abandoned.

[30] Foreign Application Priority Data

Apr. 6, 1984 [DE] Fed. Rep. of Germany ..... 3412982

[51] Int. Cl.[4] ..... D06B 5/08; D06C 5/06

[52] U.S. Cl. ..... 8/149.3; 68/5 R

[58] Field of Search ..... 8/149.3; 68/5 R, 5 D, 68/8; 134/123

[56] References Cited

U.S. PATENT DOCUMENTS

| | | | |
|---|---|---|---|
| 3,046,771 | 7/1962 | Bailey | 68/5 R |
| 4,102,643 | 7/1978 | Riedel | 8/149.3 |
| 4,431,429 | 2/1984 | Booth | 8/149.3 X |

FOREIGN PATENT DOCUMENTS

| | | | |
|---|---|---|---|
| 2727514 | 12/1978 | Fed. Rep. of Germany | 68/5 R |
| 19678 | 7/1975 | Japan | 68/5 R |

*Primary Examiner*—Philip R. Coe

*Attorney, Agent, or Firm*—Penrose Lucas Albright

[57] ABSTRACT

A strip textile fabric (7) is fixed and dehumidified by passing over a heated drum (1) in contact with a pressure belt (6) on its exposed surface. The pressure belt (6) is preheated and tensioned. As the fabric (7) passes round the periphery of the drum the moisture in the fabric is heated to the point where the steam becomes superheated.

1 Claim, 3 Drawing Sheets

CONTINUOUS TREATMENT OF STRIP TEXTILE FABRICS

RELATED APPLICATION

This is a continuation of application Ser. No. 720,741, filed Apr. 8, 1985, and now abandoned.

BACKGROUND OF THE INVENTION

1. Technical Field

The present invention relates to a method and apparatus for the continuation treatment of textiles in strip form. Such treatment includes dehumidification, drying, stablising and other heat treatments and may be applied to textile materials and fabrics of wool, wool mixtures, cotton, cotton mixtures, fibre felts and the like.

2. Prior Art

A large number of fabric finishing processes are carried out in aqueous media, others in the dry state. To remove the treatment water or moisture from the products there have been proposed a multiplicity of machines and drying methods.

In one such method known as continuous dehumidification either the squeezing pressure or calender rolls or the suction air of suction extractors is used to remove dripping water and for the partial removal of wetting water.

Devices of this type for the removal of water achieve in the most favourable cases a residual moisture content of 60 to 70%, so that the drying machines which follow in the system still have to remove, typically 45 to 55% residual moisture.

A further drawback of such water-extraction devices, particularly those that use mechanical squeezing by means of calender rolls, is that the product is exposed to a relatively high elongation stress and therefore these devices are not suitable for elongation-sensitive materials or structured fabrics.

SUMMARY OF THE INVENTION

An object of the present invention is to provide a method for the continuous dehumidification, drying and stabilization of strip material which can be effected without tensile loading of the material and which has an improved efficiency relative to the above techniques.

The present invention accordingly provides a method for the continuous dehumidification of strip material having limiting surfaces confining the fibre molecules which define intermicellar interspaces therebetween, the method including the steps of passing the strip material to be treated around the periphery of a drum, rotating the drum to drive the material therearound, heating the drum, passing a separately heated, impermeable pressure belt around the drum in contact with the material to be treated, the pressure applied by the belt to the material and the temperature of the drum being so selected that the swelling moisture in the intermicellar interspaces of fibre molecules of the material is squeezed into said limiting surfaces of the material and, during the movement of the material around said drum, is covered into superheated steam.

By means of the above method changes of form are achieved in the product and outstandingly intensive fixing and stabilisation values obtained. In addition, the degree of water elimination is also quite considerably improved. The use of this method has a very favourable effect on energy costs. In this connection it should be remembered that all such methods are greatly energy-intensive, so that, as a result of savings in energy achieved, a substantial reduction of overall operational costs may be obtained.

Since the pressure belt and the fabric being treated run synchronously, no tensile stress of any kind is produced in the article during treatment, so that even the most sensitive types of goods, with or without structured surfaces, can be treated without stretch and width losses.

The method according to the invention has a number of advantages over the calender system. For example, the present method does not cause problems as joining seams pass through. Also the expensive breakdowns which occur in calender systems when metal foreign bodies, however small they may be, enter the rolls of the calenders are avoided. With the method according to the invention, any foreign bodies encountered are pressed into the surface of the pressure belt, whence they can be easily removed. As no relative movement takes place between the pressure belt and the drum, no injuries to the material arise through such foreign bodies.

Fabrics with thickened edge strips in the form of selvedges or the like, which occur very frequently in practice, and fabrics with loose and wavy edges may readily be dealt with without any problems with the present method.

The method of the invention is particularly applicable when during the dehumidification process reshaping operations are carried out on the fabric. The results of which reshaping are effectively fixed and stabilised during the dehumidification treatment.

In a preferred embodiment the pressure belt can be tensioned in an infinitely variable manner. The surface pressure values at the circumference of the drum can thereby be raised to a maximum of 7.0 kg/cm$^2$, so that, pressure values which are higher than the expansion pressure values produced as a result of steam-gas development by 2.0 to 5.8 kg/cm$^2$ can be effectively achieved.

The invention further provides apparatus for the continuous dehumidification of strip material having two surfaces, the apparatus including a drum, means for heating the drum, means for driving the drum in rotation, an endless, impermeable pressure belt, guide rolls for supporting the pressure belt so that it passes around the periphery of said drum, means for heating said pressure belt, means for applying a tension to said pressure belt, means for transporting material to be treated such that is passes with one surface in contact with the drum and the other surface in contact with said pressure belt, the pressure applied by said pressure belt and the temperature of the drum, in use, being selectable to cause moisture in the fabric to pass into the surfaces and be converted to steam.

DESCRIPTION OF A PREFERRED EMBODIMENT

Figure 1:
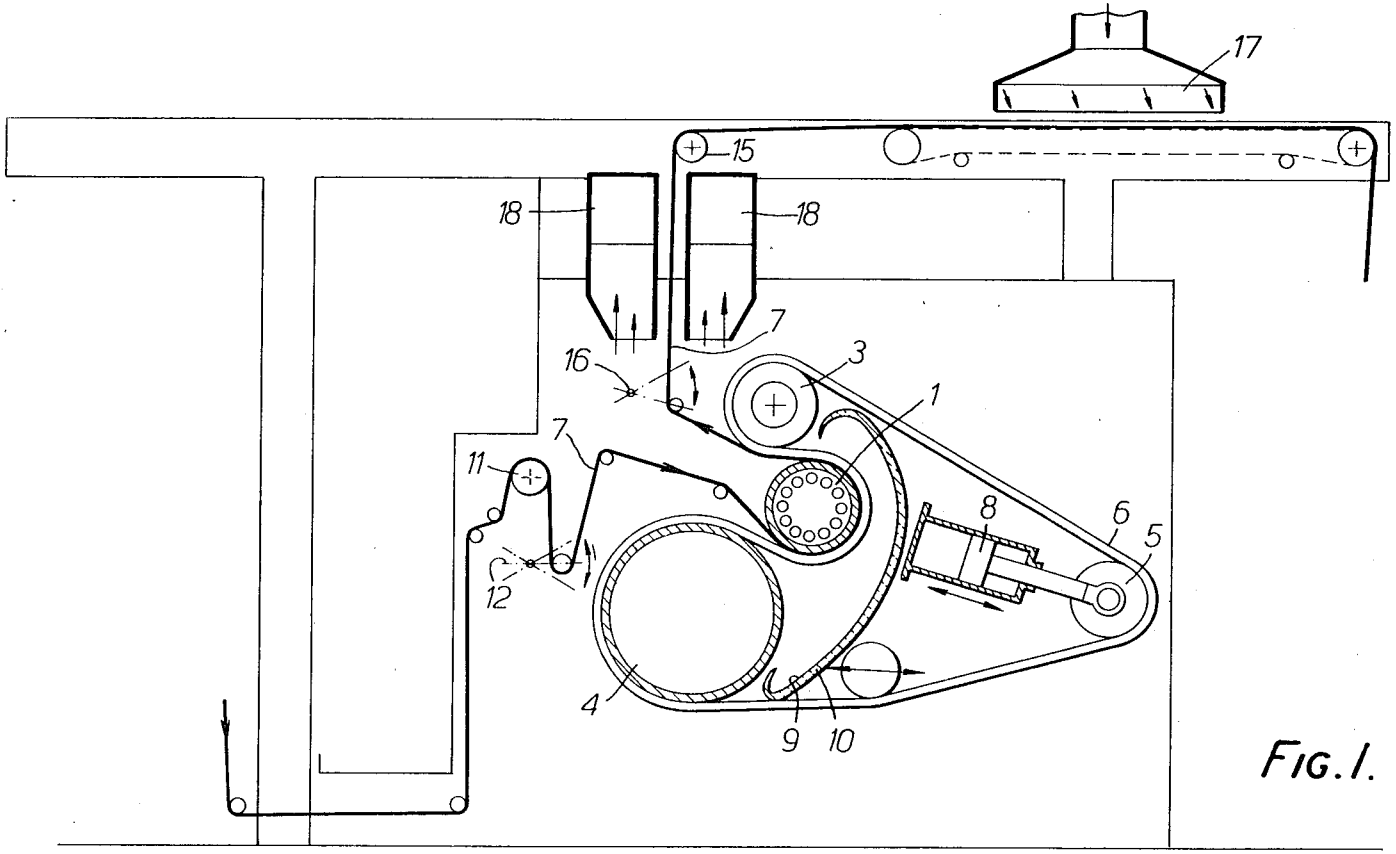
FIG. 1 is a view of apparatus for carrying out the dehumidification method of the invention.

Reference numeral 1 denotes a heatable and rotatable drum, and reference numerals 3 to 5 represent guide rolls around which a non-permeable endless pressure belt 6 is passed. This pressure belt 6 lies in the part surrounding the drum 1 directly on the surface of a strip of fabric 7 to be dehumidified. The supply and removal paths for the fabric 7 are indicated by corresponding arrows in FIG. 1.

The guide roll 4 is heated in a suitable manner so that it heats the pressure belt 6 independently of the heating of the drum 1. The diameter of the guide roll 4 is at least twice as great as the diameter of the drum. The position of the guide roll 5 and thereby the tension in the pressure belt 6 is adjustable by means of an infinitely variably drivable adjustment device 8. The pressure belt 6 can be tensioned in stepless manner during the dehumidification process of the fabric 7. With the guide roll positioned at its further position from the other guide rolls a maximum surface pressure of about 7.0 kg/cm$^2$ is applied to the fabric 7 during treatment. Depending on the nature of the fabric being treated other pressure values may also be selected. However, it is necessary that the applied tension pressure is always greater than the expansion pressure of the fabric during the dehumidification process.

A reflector 9 is provided which returns to the pressure belt 6 the heat radiated by the heated guide roll 4. The reflector is fitted with an insulation layer 10 on the side lying opposite the guide roll 4.

The fabric path to the drum 1 includes a driven supply roll 11, various guide rolls and a bouncing roller 12.

The pressure of the pressure belt 6 and the temperature of the drum 1 are selected in such a manner that the swelling moisture in the intermicellar interspaces of the fibre molecules is squeezed into the two heated limiting surfaces of the fabric 7 and is converted there into superheated steam during the movement of the fabric 7 around the periphery of drum 1.

Figure 2:
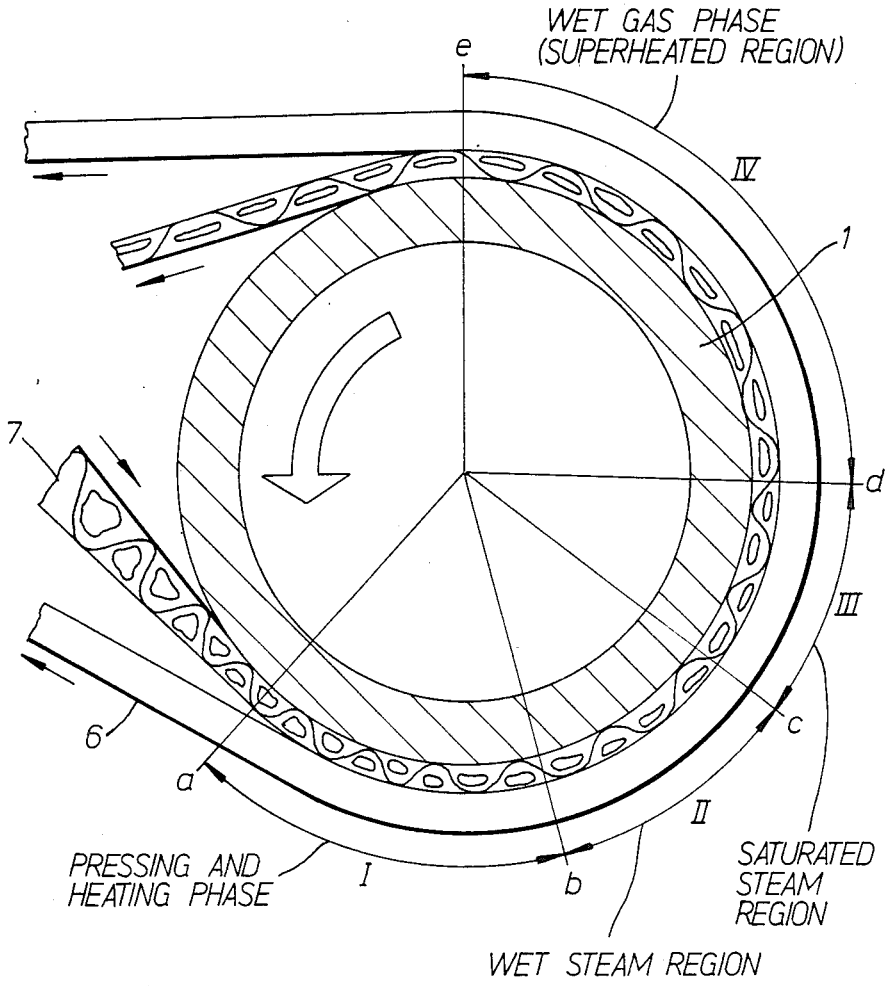
FIG. 2 is a partial view on an enlarged scale of the apparatus of FIG. 1.
Figure 3:
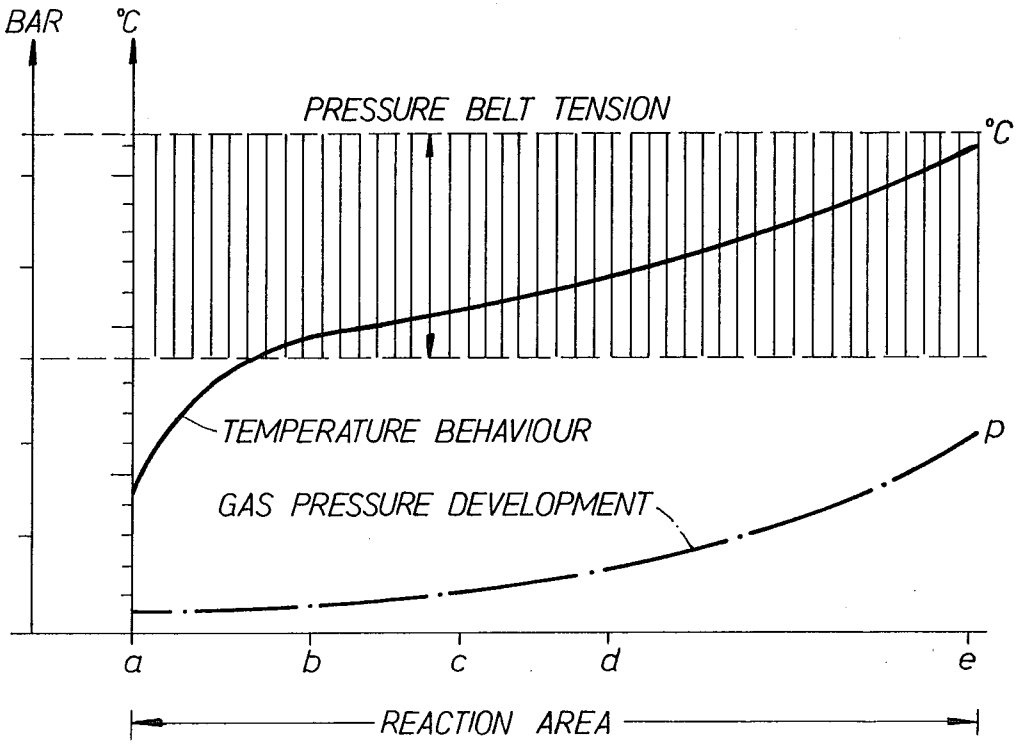
FIG. 3 is a diagram which shows the behaviour of pressure and temperature around the periphery of the drum of FIG. 2.

The dehumidification and fixation of the fabric 7 are effected as follows:

As a result of the movement of the pressure belt 6 the fabric 7 passes through four zones around the periphery of the drum 1 covered by the pressure belt 6 (FIGS. 2 and 3).

In Zone I between points a and b, as a result of the set pressure and temperature conditions e.g. 6 kg/cm$^2$ pressure and 150° C. of pressure belt 6, the operation of reshaping in the fabric 7 is first achieved. This reshaping may result in a change in the thickness of the fabric 7. During this deformation phase (Zone 1) the fabric 7 and its moisture are heated to close to the boiling point of water. Afterwards in this zone the water volume remains constant and is simply pressed by the pressure action into the pores and interspaces and into the surfaces of the fabric 7 (isochore change of state).

In Zone II between points b and c, where the temperature of the fabric 7 has either reached the boiling point of water or exceeds it, a wet steam state develops for the moisture in the fabric 7. On the further supply of heat in the area of Zone III between points c and d, this wet steam state is converted into a saturated steam state. As a result of this steam formation a gas pressure development arises through expansion of volume under the nonpermeable surface of the pressure belt 6. As the tensioning device 8 for the pressure belt 6 constantly provides a uniform preset tension, there is produced under it an isobaric state for gas development in fabric 7. The expansion pressure of the gas, which counteracts in principle the tensioning force, does not lead to a relaxation of the pressed proiduct because of the elasticity of the fabric 7, due to the considerably higher pressure value from the outside. The expansion effect, in fact, also takes place in the transverse direction of the fabric 7 (two-axis tensioning state) which brings about an increased fixation effect.

With heat being further applied, superheated steam is produced in the region of Zone IV between points d and e.

The variation in temperature and pressure as the fabric 7 passes round the periphery of the drum are diagrammatically illustrated in FIG. 2. The pressure range within which the pressure applied by the pressure belt can be adjusted is also shown in FIG. 2. It will be noted that even where the tension applied to the pressure belt 6 is at the minimum permitted by the apparatus it is in excess of the pressure generated by steam production in the fabric 7.

The isobaric state developments in zones III and IV supply a significant improvement in the intensity of fixation. The fabric 7 is duly brought to the boil under pressure.

The running-off process in the area of Zones III and IV have for practical purposes a further interesting significance, where chemical applications have been made in other finishing steps. In this case outstanding diffusion of the chemical take place in these zones.

Chemicals which simply adhere to the surfaces, and may possibly be also applied to one side only of the fabric, diffuse in the areas of Zones III and IV into each other fully homogeneously and thereby increase the degree of uniformity of impregnation.

Measurements have been carried out into the degree of fixation of the fabric 7. As compared with known continuously obtained wet fixation processes the described method supplies considerably better values. More positive values were obtained, e.g. on the determination of the creasing angle, alkali solubility and urea-bisulphite solubility, as well as on the determination of the pH vaue of the aqueous extract.

With the above described method in addition, as a consequence of the characteristic pressure and temperature conditions, there occur technological alterations in the fabric 7 itself, which lead to an improvement of feel and an increase of gloss.

For the removal of the fabric 7 there is provided a driven extraction feed roll 15 which is so regulated as regards its rotational speed by a smooth-working pendulum roller 16 that ensures a tension-free running of the fabric between the drum 1 and the extraction roll 15.

A cooling area 17 provided in the system fixes the effects achieved by means of cold air. Suction nozzles 18, which are disposed on both sides of the fabric path, take over the exhausting of the vapours released.

I claim:

1. A method for the continuous dehumidification, drying and stabilization of strip material having limiting surfaces confining the fiber molecules which define intermicellar interspaces therebetween, the method including the steps of passing the strip material to be treated around the periphery of a drum, rotating the drum to drive the material therearound, heating the drum, passing a separately heated, impermeable pressure belt around the drum in contact with the material to be treated, the pressure applied by the belt to the material and the temperature of the drum being so selected that the swelling moisture in the intermicellar interspaces of the fiber molecules of the material is squeezed into said limiting surfaces of the material and, during the movement of the material around said drum, is converted into superheated steam.

* * * * *